US005106217A

United States Patent [19]

Mecke et al.

[11] Patent Number: 5,106,217

[45] Date of Patent: * Apr. 21, 1992

[54] THERMOCOLOR RIBBON AND METHOD OF MAKING SAME

[75] Inventors: Norbert Mecke, Hanover; Heinrich Krauter, Neustadt, both of Fed. Rep. of Germany

[73] Assignee: Pelikan Aktiengesellschaft, Hanover, Fed. Rep. of Germany

[ * ] Notice: The portion of the term of this patent subsequent to Aug. 21, 2007 has been disclaimed.

[21] Appl. No.: 553,794

[22] Filed: Jul. 26, 1989

[30] Foreign Application Priority Data

Jul. 27, 1988 [DE] Fed. Rep. of Germany ..... 3825438

[51] Int. Cl.[5] ..... B41J 31/06

[52] U.S. Cl. ..... 400/241; 400/241.2; 400/120

[58] Field of Search ..... 400/120, 241, 241.1, 400/241.2, 241.4; 428/484, 488.1, 488.4, 913, 914, 195

[56] References Cited

U.S. PATENT DOCUMENTS

| | | | |
|---|---|---|---|
| 4,150,187 | 4/1979 | Brown | 400/241.2 |
| 4,549,824 | 10/1985 | Sachdev et al. | 400/241.1 |
| 4,744,685 | 5/1988 | Mecke et al. | 400/241.4 |
| 4,863,781 | 9/1989 | Kronzer | 428/484 |
| 4,950,501 | 8/1990 | Schmedes | 428/484 |

FOREIGN PATENT DOCUMENTS

| | | |
|---|---|---|
| 2823654 | 1/1979 | Fed. Rep. of Germany . |
| 62-104787 | 5/1987 | Japan . |

*Primary Examiner*—Edgar S. Burr
*Assistant Examiner*—J. R. Keating
*Attorney, Agent, or Firm*—Herbert Dubno

[57] ABSTRACT

A release layer effective for both wax-bonded and plastic-bonded or wax and plastic-bonded melt color layers is provided in a thermocolor, e.g. thermocarbon, ribbon in the form of a substance capable of splitting off water at the thermal printing temperature dispersed in a binder.

16 Claims; 1 Drawing Sheet

THERMOCOLOR RIBBON AND METHOD OF MAKING SAME

CROSS REFERENCE TO RELATED APPLICATIONS

This application is related to the commonly assigned copending applications:

| Serial Number | Filing Date |
|---|---|
| 07/109,489 | 15 Oct. 1987 |
| 07/154,651 | 10 Oct. 1988 |
| 07/152,641 | 5 Feb. 1988 |
| 07/272,599 | 16 Nov. 1988 |
| 07/351,624 | 12 May 1989 |
| 07/234,970 | 19 Aug. 1988 |

These applications refer to prior patents and publications which are also relevant to the subject matter hereof.

FIELD OF THE INVENTION

Our present invention relates to a thermocolor ribbon, especially a thermocarbon ribbon, i.e. a ribbon which, upon the application of heat and pressure, e.g. from a thermal printing head, will transfer a melt color from the ribbon to a substrate, usually in the shape of a symbol generated by the head to produce an alphanumeric or other pattern on the substrate which is usually a sheet of paper.

More particularly, the invention relates to an improved ribbon of this type where the melt color is provided upon a flexible carrier and is separated from the carrier by a release layer or separating layer facilitating transfer of the melt color from the carrier to the substrate. The invention also relates to an improved method of making such a ribbon.

BACKGROUND OF THE INVENTION

A thermocolor ribbon, also referred to as a thermal-tranfer ribbon is a ribbon which is capable of use in a thermal-transfer process in which the ribbon is provided with a color-transfer ribbon, i.e. the melt color can be transferred upon being raised to a melting temperature of this layer, portionwise and in a pattern as noted, to a substrate which receives the print.

The substrate can be, as noted, a paper sheet which can be displaced by a platen relative to the print head and the print head can be provided to engage the ribbon on the side of the carrier opposite that which is provided with the melt color to press the ribbon against the substrate at the requisite temperature to effect a melting of the color-transfer layer at least in a local region at which such pressure is applied and to effect the transfer of an appropriate symbol selected in the head to the substrate.

Generally the color-transfer layer comprises a wax-bonded or plastic-bonded melt color, at least on the side turned toward the substrate which receives the print and on which the transfer portion of the melt color is bonded to form the printed symbol thereon.

Thermocolor ribbons, also known as thermocarbon ribbons when the pigment of the color-transfer layer includes or consists of carbon black, have long been known. Generally they comprise a foil-like carrier, for example of paper, a plastic or the like, and a color-transfer layer in the form of the melt color applied thereto. The color-transfer layer is in the form of a plastic-bonded and/or wax-bonded coloring agent or carbon black layer.

The melt color of the thermocolor ribbon can be melted by the action of a thermal printing head for transfer to a receiving substrate which can be a printing paper or some other suitable paper substrate. Thermal printers or thermal printer heads which can be used for this process are known, for example, from German printed applications DE-AS 2,062,494 and 2,406,613, as well as from German open application DE-OS 3,224,445. Such ribbons as may be used with these printers can be referred to as "TCR" ribbons, i.e. thermal-carbon ribbons. The thermal printing head of the printer can generate the symbols, such as alphanumeric characters, as heated points which press against the reverse side of the ribbon, i.e. the side opposite the side provided with the melt color. The heated symbol, such as an alphanumeric character of the printing head, can be at a temperature of about 400° C. which is sufficient to locally melt the melt color at the heated selection and effect transfer of the locally heated pattern as it comes into contact with the paper sheet. The used portion of the thermal-color ribbon can be taken up on a spool.

The thermocolor ribbon can be provided with a plurality of different melt colors adjacent one another. For example, with a combination of the basic colors blue, yellow and red, it is possible to produce colored printed images. The advantage of this process, by comparison to conventional color photography, is that the disadvantageous development and fixing steps can be eliminated. Thermal printers can operate with great printing speeds. For example, a German Industrial Standard DIN A4 page can be printed in 10 seconds without detrimental noise generation.

Mention may also be made of another process which also uses thermocolor ribbons but wherein the symbol transfer is not effected by the use of a heated symbol of the printing head, but rather is a consequence of resistance heating generated in a special foil-like character.

The melt color here forms a functional layer which is locally brought to a temperature sufficient to melt the layer by the resistance heating applied for transfer of the symbol.

Since the ribbon is electrically conductive, in the field the process is referred to as an electrothermal process and the ribbon has an electrothermal ribbon (ETR). A corresponding thermal-transfer printing system is described, for example, in U.S. Pat. No. 4,309,117.

It has been found that in thermal-printing processes of the aforedescribed type, sometimes difficulties arise in the release of the melt color from the heated location of the carrier material.

To solve this problem a variety of proposals can be found in the art. For example, in European patent application 86,301,743 (publication No. 0 194 860) for example, it is proposed to provide between a plastic-bonded melt color and its carrier or support, a thermally activated meltable "release layer" which contains as its principal component, preferably, a wax.

The disadvantage of this system is that it cannot be used with advantage for those thermocolor ribbons which utilize a wax-bonded melt color.

OBJECTS OF THE INVENTION

It is the principal object of our present invention to provide an improved thermocolor ribbon so that a release of the melt color during the printing process is facilitated whether the melt color is wax-bonded or plastic-bonded, without, however, bringing about premature separation of the melt-transfer layer from the carrier.

Another object of this invention is to provide an improved method of making a thermal color ribbon which avoids drawbacks of earlier methods.

SUMMARY OF THE INVENTION

These objects and others which will become apparent hereinafter are attained, in accordance with the present invention, in a thermocolor ribbon of the type described, in which the release layer consists essentially of a substance capable of thermally splitting off water at the printing temperature and dispersed in a binder.

Specifically, the thermocolor ribbon of the invention can comprise:

a support strip;

a melt-color transfer layer containing at least one coloring agent and melting at a thermal printing temperature for transfer of a symbol formed by local heating of the thermocolor ribbon and pressure thereon to a substrate; and a release layer between the support strip and said transfer layer and consisting essentially of a substance capable of splitting off water at a temperature of said local heating and dispersed in a binder.

The method of making the thermocolor ribbon can comprise the steps of:

(a) forming an aqueous dispersion in a binder of a substance capable of splitting off water at a temperature of local heating of the thermocolor ribbon for transfer of a symbol formed by the local heating of the thermocolor ribbon and pressure thereon to a substrate so that the substance is dispersed or dissolved in the dispersion;

(b) applying the dispersion to a surface of a thermocolor ribbon support;

(c) drying the dispersion on said support to form a release layer with said substance dispersed in said binder; and (d) applying a melt-color transfer layer containing at least one coloring agent and melting at a thermal printing temperature for transfer of said symbol, to said release layer, thereby forming the ribbon.

When we refer here to the printing conditions at which the water can be split from the substance, we intend thereby to make clear that, in the absence of a printing temperature, the water will remain chemically or physically bonded to the substance in such fashion that it is not released. The release of the water, since both wax-bonded and plastic-bonded melt colors are hydrophobic in the molten state, will effectively mobilize the melt color in the printing region. Primarily the printing condition of importance is the temperature at which the thermoprinting can take place. According to the invention, therefore, upon heating of the ribbon to the printing temperature, at least a portion of the substance from which water can be split liberates contained bonded water to impart a hydrophilic character to the release layer during the printing process.

This effect can be triggered by heating to a temperature of 50° to 400° C. and, indeed, the water release can be triggered even before the melt color has reached a full molten state in the heated region. Normally the temperature at which the water is released is at the higher end of this range.

The weight percent of the substance capable of splitting off water in the release layer is not critical to the invention. This is because a relatively small amount of water will provide the desired effect when released during the printing process and only such small amount is required to impart the desired hydrophility character to the release layer. However, to provide guidelines for the amount of the substance which can be included in the layer, it may be observed that the release layer can consist of 10 to 80% by weight of the substance, the balance being the binder.

The substance capable of splitting off water at the thermal printing temperature can be an organic or inorganic component containing water of crystallization, such as alum, borax, Glauber's salt, zeolites, citric acid and/or oxalic acid. The compounds with especially high crystal water content are preferred, for example, alums like aluminum, iron and chromium alum and borax.

The choice of the binder for this substance in the release layer is also reasonably wide-ranging. Preferred are water soluble organic binders, especially polyvinylpyrrolidone, polyvinylacetate, methylcellulose, water-soluble starch, water-soluble starch derivatives, polyvinylalcohol, casein and the like. While the thickness of the release layer is not critical, preferably it lies between 0.1 and 2 micrometers, preferably between 0.5 and 1.0 micrometer. In general the thinnest practical layer providing the described effect will give the best result.

The thermocolor ribbon of the invention can advantageously be made by the following method:

One or more of the above-described binders are brought into an aqueous solution with the substance capable of splitting off water at the thermal printing temperature. This solution can contain most advantageously 40 to 60 parts by weight of the substance and 40 to 60 parts by weight of the binder, in addition to solution water. The solution is applied by conventional techniques to the carrier which can be any of the films or foils described, for example in application Ser. No. 07/351,624.

The films or carrier foils of the other applications mentioned also may be used.

After application of the solution by, for example, a doctor blade, the solution water is evaporated to leave a release layer in a thickness of the above-described range. Evaporation of the solution water is preferably effected by passing warm air over the coated carrier at a temperature of about 80° to 120° C. The melt color, which can be any of the wax-bonded and/or plastic-bonded melt colors of the aforementioned applications can then be applied.

The system has the advantage that the release layer is effective to promote transfer of the melt color at the thermal printing temperature regardless of the type of melt color used, i.e. whether this melt color is a wax-bonded melt color or not. The separation is especially clean and effective and the release layer brings about an especially clean and rapid transfer so that high-density images can be produced.

Apparently the effect upon thermal printing derives not only from the fact that water is liberated from the substance but also from the fact that the water as liberated evaporates rapidly to produce an interfacial-steam phase which may facilitate transfer.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
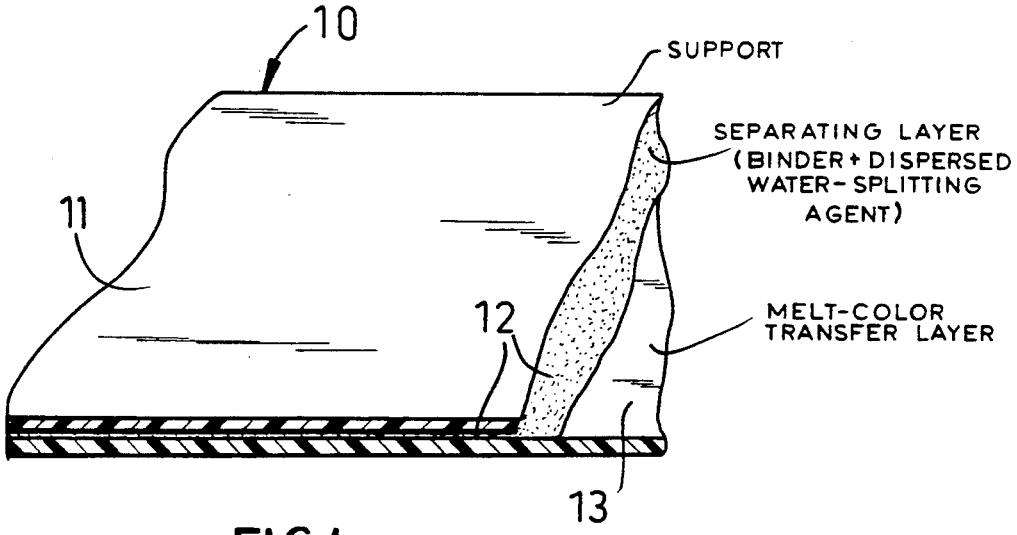
FIG. 1 is a perspective view, partly broken away, of a portion of a thermal printing ribbon according to the invention.

The ribbon 10 shown in FIG. 1 comprises a foil support 11 onto which the separating or release layer 12 is applied in the manner described and so as to consist of a binder and a substance capable of splitting water and dispersed therein. The melt-color transfer layer 13 is applied on the release or separating layer 12.

Figure 2:
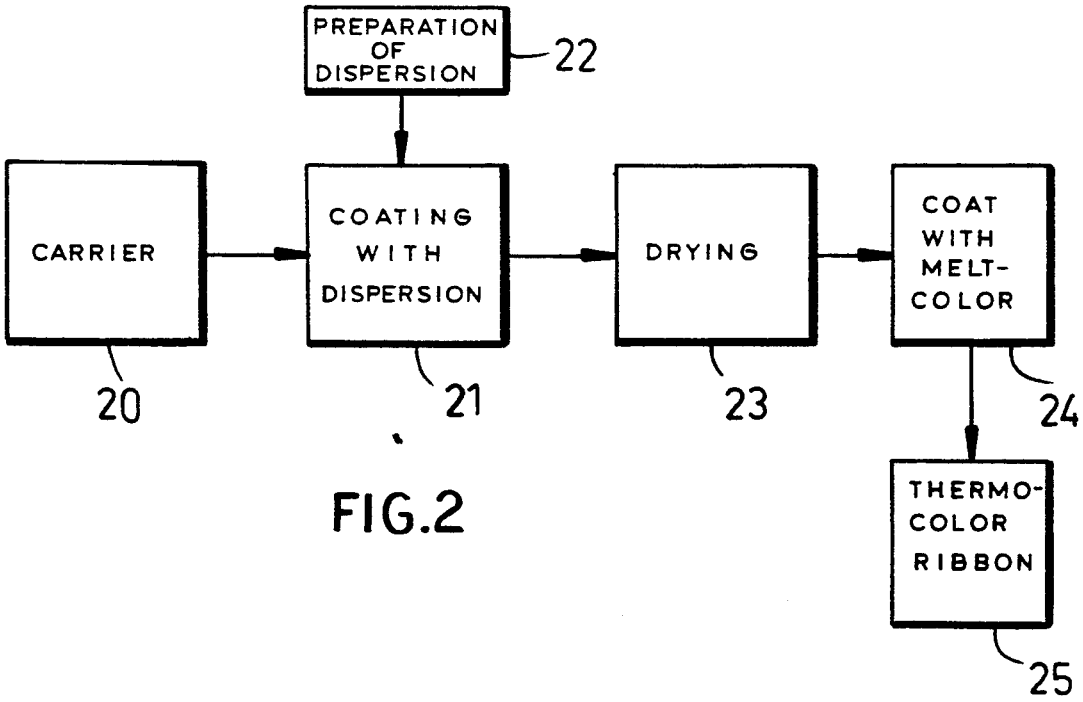
FIG. 2 is a flow diagram representing the method.

As is apparent from FIG. 2, the carrier is fed at 20 to a coating stage 21 in which the solution or dispersion formed at 22 from the binder and the water-splitting substance is coated onto the carrier. Warm-air drying of the resulting release layer is effected at 23 and the release layer is coated with the melt color at 24 by any of the techniques described in the aforementioned copending applications. This, upon handling of the melt layer, yields the thermocolor ribbon shown in FIG. 1 at 25.

SPECIFIC EXAMPLES

Example I

A carrier consisting of a polyester foil of a thickness of about 6 micrometers is coated by a doctor blade with a composition consisting of 0.5 parts by weight borax, 0.5 parts by weight polyvinylpyrrolidone, 3.0 parts by weight water and 1.0 part by weight ethanol.

The coating is dried as described previously to yield a release layer of a thickness of 0.2 micrometer. The drying is carried out by passing hot air at a temperature of 110° C. over the coated foil.

A melt is formed at a temperature of 105° C. of 40 parts by weight ethylene-vinylacetate mixed polymerizate, 40 parts by weight paraffin and 20 parts by weight carbon black. This melt is applied at a temperature of 105° C. with a Flexoprinter to form the color-transfer layer or melt color layer in a thickness of about 4 micrometers. Utilizing a conventional printer head and conventional thermal printing temperature, this thermocolor ribbon shows a complete, rapid and clean transfer of the melt color at the printing location to generate high resolution symbols on the substrate paper sheet.

EXAMPLE II

Example 1 is modified in that the composition for forming the release layer is modified to consist of 0.5 parts by weight oxalic acid, 0.5 parts by weight polyvinylpyrrolidone, 3 parts by weight water and 1.0 part by weight ethanol. Similar results are obtained.

We claim:

1. A thermocolor ribbon, comprising:

a support strip;

a melt-color transfer layer containing at least one coloring agent, said transfer layer characterized by undergoing melting at a thermal printing temperature sufficient for transfer of a symbol under local heating of the thermocolor ribbon and pressure thereon to a substrate; and a release layer between said support strip and said transfer layer, said release layer consisting essentially of a binder and a substance from which water splits off at a temperature of said local heating, said substance being dispersed in said binder.

2. The thermocolor ribbon defined in claim 1 wherein said release layer consists essentially of 10 to 80 percent by weight of said substance, any remaining amounts of said release layer being formed of said binder.

3. The thermocolor ribbon defined in claim 2 wherein said release layer has a thickness of substantially 0.1 to 2 micrometers.

4. The thermocolor ribbon defined in claim 3 wherein said substance that splits off water is a compound selected from the group consisting of an inorganic and an organic compound containing water of crystallization.

5. The thermocolor ribbon defined in claim 4 wherein said compound is selected from the group consisting of alum, borax, Glauber's salt, zeolites, citric acid, oxalic acid and mixtures thereof.

6. The thermocolor ribbon defined in claim 5 wherein said binder is selected from the group consisting of polyvinylpyrrolidone, polyvinylacetate, methylcellulose, water-soluble starch, starch derivatives, polyvinylalcohol, casein and mixtures thereof.

7. The thermocolor ribbon defined in claim 1 wherein said release layer has a thickness of substantially 0.1 to 2 micrometers.

8. The thermocolor ribbon defined in claim 1 wherein said substance that splits off water is a compound selected from the group consisting of an inorganic and an organic compound containing water of crystallization.

9. The thermocolor ribbon defined in claim 8 wherein said compound is selected from the group consisting of alum, borax, Glauber's salt, zeolites, citric acid, oxalic acid and mixtures thereof.

10. The thermocolor ribbon defined in claim 1 wherein said binder is selected from the group consisting of polyvinylpyrrolidone, polyvinylacetate, methylcellulose, water-soluble starch, starch derivatives, polyvinylalcohol, casein and mixtures thereof.

11. A method of making a thermocolor ribbon which comprises the steps of:

(a) forming an aqueous dispersion comprising a binder and a substance;

(b) applying said dispersion to a surface of a thermocolor ribbon support;

(c) drying said dispersion on said support to form a release layer with said substance dispersed in said binder, said substance being characterized by water splitting off therefrom at a temperature of local heating of the thermocolor ribbon; and (d) applying a melt-color transfer layer containing at least one coloring agent and melting at a thermal printing temperature for transfer of said symbol, to said release layer, thereby forming said ribbon.

12. The method defined in claim 11 wherein said release layer consists essentially of 10 to 80 percent by weight of said substance, any remaining amounts of said release layer being formed of said binder.

13. The method defined in claim 12 wherein said release layer has a thickness of substantially 0.1 to 2 micrometers.

14. The method defined in claim 13 wherein said substance from which water splits off at a temperature of said local heating is a compound selected from the group consisting of an inorganic and an organic compound containing water of crystallization.

15. The method defined in claim 14 wherein said compound is selected from the group consisting of alum, borax, Glauber's salt, zeolites, citric acid, oxalic acid and mixtures thereof.

16. The method defined in claim 15 wherein said binder is selected from the group consisting of polyvinylpyrrolidone, polyvinylacetate, methylcellulose, water-soluble starch, starch derivatives, polyvinylalcohol, casein and mixtures thereof.

* * * * *